US007938510B2

(12) United States Patent
Kubo et al.

(10) Patent No.: US 7,938,510 B2
(45) Date of Patent: May 10, 2011

(54) LIQUID EJECTION HEAD AND LIQUID EJECTION METHOD

(75) Inventors: Naomi Kubo, Hachioji (JP); Yasuo Nishi, Hachioji (JP); Atsuro Yanata, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 344 days.

(21) Appl. No.: 12/224,048

(22) PCT Filed: Feb. 15, 2007

(86) PCT No.: PCT/JP2007/052703

§ 371 (c)(1),
(2), (4) Date: Aug. 15, 2008

(87) PCT Pub. No.: WO2007/099773

PCT Pub. Date: Sep. 7, 2007

(65) Prior Publication Data

US 2010/0182361 A1 Jul. 22, 2010

(30) Foreign Application Priority Data

Feb. 28, 2006 (JP) ..... 2006-052418

(51) Int. Cl.
*B41J 2/01* (2006.01)

(52) U.S. Cl. ..... 347/55

(58) Field of Classification Search ..... 347/55, 347/68, 20, 54
See application file for complete search history.

(56) References Cited

U.S. PATENT DOCUMENTS

| | | | | |
|---|---|---|---|---|
| 5,828,393 | A * | 10/1998 | Hotomi | 347/71 |
| 6,036,302 | A * | 3/2000 | Hotomi | 347/55 |
| 7,611,228 | B2 * | 11/2009 | Onozawa | 347/55 |
| 7,628,473 | B2 * | 12/2009 | Onozawa | 347/68 |
| 7,690,766 | B2 * | 4/2010 | Ueno et al. | 347/55 |
| 2009/0079794 | A1 * | 3/2009 | Date et al. | 347/55 |
| 2009/0096837 | A1 * | 4/2009 | Kubo et al. | 347/55 |

FOREIGN PATENT DOCUMENTS

JP 05-104725 A 4/1993

(Continued)

OTHER PUBLICATIONS

U.S. Appl. No. 12/224,049, filed Aug. 15, 2008, Confirmation No. 4095.

*Primary Examiner* — Huan H Tran
(74) *Attorney, Agent, or Firm* — Holtz, Holtz, Goodman & Chick PC

(57) ABSTRACT

A liquid ejection head including: an insulating nozzle plate 5 provided with a nozzle having, a liquid supply port to supply liquid and a ejection port to eject the liquid supplied from the liquid supply port onto a substrate; a cavity in communication with the liquid supply port to reserve the liquid to be ejected from the ejection port; an electrostatic voltage application device to generate an electrostatic attraction force by applying the electrostatic voltage between the liquid in the nozzle and in the cavity, and substrate; and a control device to control application of the electrostatic voltage through the electrostatic voltage application device; wherein the nozzle is a flat nozzle not protruding from the nozzle plate and the control device control the electrostatic voltage application device so as to eject the liquid from the nozzle by applying a bipolar pulse which alternates between negative and positive polarity.

10 Claims, 7 Drawing Sheets

FOREIGN PATENT DOCUMENTS

| | | | | |
|---|---|---|---|---|
| JP | 05-278212 | A | | 10/1993 |
| JP | 06-134992 | A | | 5/1994 |
| JP | 10-166592 | A | | 6/1998 |
| JP | 2003-053977 | A | | 2/2003 |
| JP | 2005-058810 | A | | 3/2005 |
| JP | 2005-186290 | | * | 7/2005 |
| JP | 2007-230018 | | * | 9/2007 |
| WO | WO 03/070381 | A1 | | 8/2003 |
| WO | WO 2006/067966 | A1 | | 6/2006 |
| WO | WO 2006/068036 | A1 | | 6/2006 |

* cited by examiner

LIQUID EJECTION HEAD AND LIQUID EJECTION METHOD

This application is the United States national phase application of International Application PCT/JP2007/052703 filed Feb. 15, 2007.

TECHNICAL FIELD PERTAINING TO THE INVENTION

The present invention relates to a liquid ejection head, and liquid ejection method, and in particular, to a liquid ejection head having a flat nozzle, and a liquid ejection method using the liquid ejection head thereof.

PRIOR ART

As a technology to eject high viscosity liquid besides low viscosity liquid from a micro nozzle of a liquid ejection head, there has been known a liquid ejection technology using an electrostatic attraction method wherein liquid in the nozzle is charged and ejected by an electrostatic attraction force excited by an electric filed created between the nozzle and various kinds of substrates representing an object on which liquid droplets land (International Publication No. 03/070381 Pamphlet)

Also, development of an electric field assist method where the above liquid ejection technology and a liquid ejection technology using a pressure created by forming of bubbles inside the liquid or by distortion of a piezoelectric element are combined is being promoted (Unexamined Japanese Patent Application Publication Nos. H5-104725, H-278212, H6-134992, H10-166592, 2003-53977 and 2005-058810). In the Patent Document 2003-53977, there is disclosed a liquid ejection head to eject the liquid where the electrostatic voltage is synchronized with printing pulse of the piezoelectric element. Also, in the Patent Document No. 2005-058810, there is disclosed an electrostatic attraction type ejection apparatus, wherein the liquid is ejected by applying a bipolar pulse which alternates between positive and negative polarity between the nozzle and an ejection front end member. Such electric field assist method is an ejection method where a liquid meniscus is raised at an ejection port of the nozzle using a meniscus forming device and the electrostatic attraction force imposed on the meniscus is enhanced to make the meniscus to be a liquid droplet against a surface tension of the liquid.

It is known that using a nozzle plate of high resistance material having a volume resistivity of $10^{15}$ Ωm or more for the above liquid ejection head of electrostatic attraction method or electric field assist method, even for a flat shape without the ejection port being protruded, the electric field is created between the head and a counter electrode by applying electrostatic voltage onto the liquid in the nozzle, thereby a meniscus of the liquid is formed at the ejection port of the nozzle, then an intensive concentration of the electric field occurs at the meniscus, thus the meniscus is transformed into a liquid droplet and ejected by the electrostatic attraction force caused by the concentrated electric field (International Publication No. 06/067966 Pamphlet).

Further, it is known that by combining a meniscus generating device using a pressure generating device (piezoelectric element), the electrostatic voltage to be applied can be lowered (International Publication No. 06/068036 Pamphlet).

Patent Document 1: International Publication No. 03/070381 Pamphlet

Patent Document 2: Unexamined Japanese Patent Application Publication No. H5-104725

Patent Document 3: Unexamined Japanese Patent Application Publication No. H5-278212

Patent Document 4: Unexamined Japanese Patent Application Publication No. H6-134992

Patent Document 5: Unexamined Japanese Patent Application Publication No. H10-166592

Patent Document 6: Unexamined Japanese Patent Application Publication No. 2003-53977

Patent Document 7: Unexamined Japanese Patent Application Publication No. 2005-058810

Patent Document 8: International Publication No. 06/067966 Pamphlet

Patent Document 9: International Publication No. 06/068036 Pamphlet

DISCLOSURE OF THE INVENTION

Problems to be Solved by the Present Invention

However, there was found a problem that though the nozzle plate of high resistance material or the meniscus forming device is combined with the liquid ejection head of the electrostatic attraction method or the electric field assist method described in Patent Documents 1 to 7, ejection of the liquid droplet becomes inconsistent or ejection of liquid ceases if the electrostatic voltage is applied continuously for a long time.

The phenomenon is that the concentrated electric field intensity at a front end of the meniscus decreases due to space-charge polarization (ionic polarization) of the nozzle plate and ejection of the liquid becomes impossible. In this case, the liquid cannot be ejected again unless space-charge polarization of the nozzle plate is resolved and the nozzle plate is brought back to an initial condition. However, there was a problem that it is time consuming to resolve space-charge polarization thus ejection operation cannot be performed in the meantime, therefore productivity is deteriorated if such liquid ejection head is used for an industrial application.

Therefore, an object of the present invention is to provide a liquid ejection head, and liquid ejection method to realize suppressing of occurrence of polarization on the nozzle plate.

Means to Solve the Problems

To solve the problems thereof, the configuration of item 1 is a liquid ejection head comprising:

an insulating nozzle plate provided with a nozzle having, a liquid supply port to supply liquid and an ejection port to eject the liquid supplied from the liquid supply port onto a substrate;

a cavity in communication with the liquid supply port to reserve the liquid to be ejected from the ejection port;

an electrostatic voltage application device to generate an electrostatic attraction force by applying the electrostatic voltage between the liquid in the nozzle and in the cavity, and substrate; and a control device to control application of the electrostatic voltage through the electrostatic voltage application device;

wherein the nozzle is a flat nozzle not protruding from the nozzle plate and the control device controls the electrostatic voltage application device so as to eject the liquid from the nozzle by applying a bipolar pulse which alternates between negative and positive polarities.

According to the configuration of item 1, though the electric field intensity is deteriorated and liquid ejection becomes impossible due to polarization of the nozzle plate when liquid ejection operation is continued for along time of period by applying the electrostatic voltage having the same polarity between the insulating flat nozzle plate and the counter electrode, the polarization of the nozzle plate can be suppressed by applying positive pulse and negative pulse alternately to carry out liquid ejection operation. Thereby in case the liquid ejection head 2 is used in a production line, ejection operation can be continued without deteriorating productivity due to defective liquid ejection.

The configuration of item 2 is the liquid ejection head of item 1, wherein the bipolar pulse is a bipolar pulse in which an integrated value of the electrostatic voltage value of the positive pulse with respect to pulse time equates to an integrated value of the electrostatic voltage value of the negative pulse with respect to pulse time.

According to the configuration of items 2, the polarization of the nozzle plate can be prevented by applying the negative pulse having the same integrated value of the electrostatic voltage value with respect to the pulse time as that of the positive pulse after applying the positive pulse. The configuration of item 3 is the liquid ejection head of item 1 or 2, wherein the pulse time of at least one of positive pulse or negative pulse of the bipolar pulse is not less than a predetermined time from ejection of the liquid through the nozzle to landing of the liquid thereof onto the substrate.

According to the configuration of item 3, if the pulse time of each positive pulse and negative pulse is less than the predetermined time by landing of the liquid droplet onto the substrate, the polarity of the application voltage is reversed before the liquid droplet lands on the substrate. However, by preventing the application voltage form reversal of polarity while the liquid droplet is flying, the deviation of landing position of the liquid droplet can be prevented.

The configuration of item 4 is the liquid ejection head of any one of items 1 to 3, further comprising a pressure generating device to generate a pressure in the liquid by changing a volume of the cavity for forming a meniscus at the ejection port, wherein the control device drives the pressure generating device so as to synchronize with the bipolar pulse.

According to the configuration of item 4, by synchronizing drive of the piezoelectric element with the bipolar pulse, the ejection timing does not deviate in respect to the electrostatic wave thus reversal of polarity of the application voltage is prevented while the liquid droplet is flying.

The configuration of item 5 is the liquid ejection head of any one of items 1 to 4, wherein a volume resistivity of the nozzle plate is not less than $10^{15}$ Ωm.

According to the configuration of item 5 by making the volume resistivity of the nozzle plate not less than $10^{15}$ Ωm, a strong electric field can be created at the meniscus front end and the liquid droplet can be ejected consistently and efficiently.

The configuration of item 6 is the liquid ejection head of any one of items 1 to 5, wherein an inside diameter of the ejection port is less than 15 μm.

According to the configuration of item 6, by making the inside diameter of the ejection port less than 15 μm, the electric field at meniscus front end section concentrates effectively, thus the liquid droplet can be ejected steady and efficiently.

The configuration of item 7 is a liquid ejection method, comprising:

using a liquid ejection head having;

an insulating nozzle plate provided with a nozzle having, a liquid supply port to supply liquid and an ejection port to eject the liquid supplied from the liquid supply port onto a substrate, a cavity in communication with the liquid supply port to reserve the liquid to be ejected from the ejection port, an electrostatic voltage application device to generate an electrostatic attraction force by applying the electrostatic voltage between the liquid in the nozzle and in the cavity, and substrate, and a control device to control application of the electrostatic voltage through the electrostatic voltage application device;

wherein the nozzle is a flat nozzle not protruding from the nozzle plate and the control device controls the electrostatic voltage application device so as to eject the liquid from the nozzle by applying a bipolar pulse which alternates between negative and positive polarities.

According to the configuration of item 7 though the electric field intensity is deteriorated and liquid ejection becomes impossible due to polarization of the nozzle plate when liquid ejection operation is continued for a long time of period by applying the electrostatic voltage having the same polarity between the insulating flat nozzle plate and the counter electrode, the polarization of the nozzle plate can be suppressed by applying positive pulse and negative pulse alternately to carry out liquid ejection operation. Thereby in case the liquid ejection head is used in a production line, ejection operation can be continued without deteriorating productivity due to defective liquid ejection.

The configuration of item 8 is an ejection method of item 7, wherein the bipolar pulse is a bipolar pulse in which an integrated value of the electrostatic voltage value of the positive pulse with respect to pulse time equates to an integrated value of the electrostatic voltage value of the negative pulse with respect to pulse time.

According to the configuration of items 8, the polarization of the nozzle plate can be prevented by applying the negative pulse, having the same integrated value of the electrostatic voltage value with respect to the pulse time as that of the positive pulse, after applying the positive pulse.

The configuration of item 9 is the liquid ejection method of item 7 or 8, wherein the pulse time of at least one of positive pulse or negative pulse of the bipolar pulse is not less than a predetermined time from ejection of the liquid through the nozzle to landing of the liquid thereof onto the substrate.

According to the configuration of item 9, if the pulse time of each positive pulse and negative pulse is less than the predetermined time by landing of the liquid droplet onto the substrate, the polarity of the application voltage is reversed before the liquid droplet lands on the substrate. However, by preventing the application voltage form reversal of polarity while the liquid droplet is flying, the deviation of landing position of the liquid droplet can be prevented.

The configuration of item 10 is the liquid ejection method of any one of item 7 to 9, further comprising a pressure generating device to generate a pressure in the liquid by changing a volume of the cavity for forming a meniscus at the ejection port, wherein the control device drives the pressure generating device so as to synchronize with the bipolar pulse.

According to the configuration of item 10, by synchronizing drive of the piezoelectric element with the bipolar pulse, the ejection timing does not deviate in respect to the electrostatic wave thus reversal of the polarity of the application voltage is prevented while the liquid droplet is flying.

The configuration of item 11 is the liquid ejection method of any one of items 7 to 10, wherein the volume resistivity of the nozzle plate is not less than $10^{15}$ Ωm.

According to the configuration of item 11 by making the volume resistivity of the nozzle plate not less than $10^{15}$ Ωm, a strong electric field can be created at the meniscus front end section and the liquid droplet can be ejected consistently and efficiently.

The configuration of item 12, is the liquid ejection method of any one of items 7 to 11, wherein an inside diameter of the ejection port is less than 15 μm.

According to the configuration of item 12, by making the inside diameter of the ejection port less than 15 μm, the electric field at the meniscus front end section concentrates effectively, thus the liquid droplet can be ejected steady and efficiently.

Effects of the Invention

According to the configuration of item 1 or 7, ejection of the liquid droplet can be continued while suppressing polarization of the nozzle plate thus occurrence of defective ejection due to polarization can be suppressed. Thereby, liquid ejection operation can be continued without productivity being deteriorated due to defective liquid ejection.

According to the configuration of item 2 or 8, polarization of the nozzle plate can be prevented by applying negative pulse, thus occurrence of defective ejection due to polarization can be prevented.

According to the configuration of item 3 or 9, deviation of the liquid droplet landing position can be prevented.

According to the configuration of item 4 or 10, reversal of polarity of the electrostatic voltage is prevented while the liquid droplet is flying, thereby deviation of the liquid droplet landing position can be prevented.

According to the configuration of item 5 or 11, the liquid droplet can be ejected consistently and efficiently.

According to the configuration of item 6 or 12, the liquid droplet can be ejected consistently and efficiently.

DESCRIPTION OF THE SYMBOLS

Figure 1:
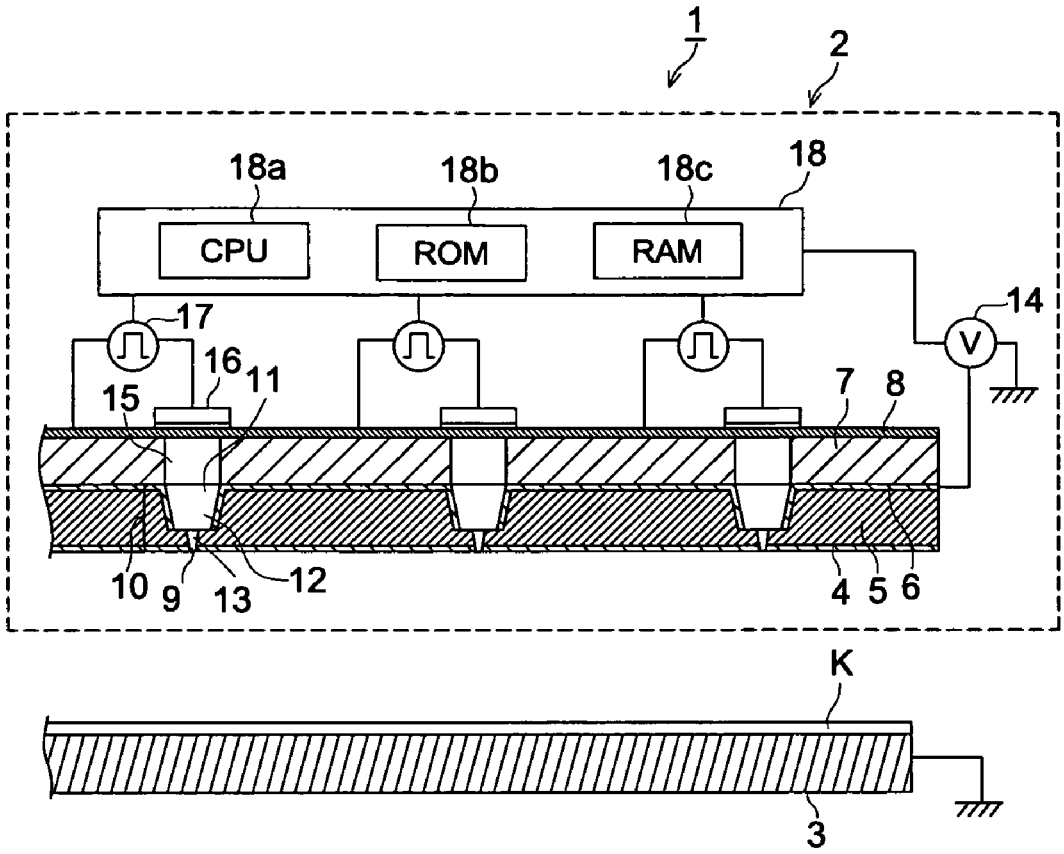
FIG. 1 is a schematic structural diagram showing a total structure of the liquid ejection head related to the present embodiment.

1 Liquid ejection apparatus
2 Liquid ejection head
3 Counter electrode
4 Ejection surface
5 Nozzle plate
6 Charging electrode
7 Body layer
8 Flexible layer
9 Ejection port
10 Nozzle
11 Liquid supply port
12 Large bore section
13 Small bore section
14 Electrostatic voltage power source
15 Cavity
16 Piezoelectric element
17 Drive voltage power source
18 Control device

DETAILED DESCRIPTION OF THE PREFERRED EMBODIMENT

An embodiment of the present invention will be described with reference to the drawings.

FIG. 1 is a cross-sectional schematic view indicating a total structure of a liquid ejection apparatus 1 of the present embodiment.

As FIG. 1 shows, the liquid ejection apparatus 1 is configured with a line method liquid ejection head 2 to eject a liquid droplet capable of being charged such as ink and a counter electrode 3 facing the liquid ejection head 2 so as to support a substrate K on which the liquid droplet lands.

As FIG. 1 shows, in the liquid ejection head 2, an ejection surface 4, a nozzle plate 5, a charging electrode 6, a body layer 7 and a flexible layer 8 are arranged in laminae.

The ejection surface 4 is positioned at a side facing to the counter electrode 3 of the liquid ejection head 2 and the liquid is ejected from an ejection port 9 opening on the ejection surface 4 onto the substrate K supported by the counter electrode 3.

A nozzle plate 5 is configured with a silica glass on which a plurality of nozzles 10 are formed by peroration. Also, a volume resistivity of the nozzle plate 5 is not less than $10^{15}$ Ωm. Thereby, a strong electric field can be obtained at the front end section of the meniscus formed at the ejection port 9.

Meanwhile, a material used for the nozzle plate 5 can be an insulation resin material without being limited to the silica glass. High resistance resin materials having a volume resistivity of not less than $10^{15}$ Ωm such as polyimide (PI), polyethylene terephthalate (PET), polyethylene naphthalate (PEN), polytetrafluoroethylene (PTFE) and polypropylene (PP) can be preferably utilized.

Each nozzle 10 has a two step structure which includes a large bore section 12 communicating with a liquid supply port 11 to receive supply of the liquid and a small bore section 13 opening on a bottom surface of the large bore section 12 and communicating with the ejection port 9.

In the present embodiment, an opening area of the liquid supply port 11 is configured to be more than ten times as large as an opening area of the ejection port 9. Also, a length of the small bore section 13 is not more than 15 μm. Thus, the meniscus of the liquid can be raised in a predetermined amount, and the liquid can be ejected consistently even if the drive voltage required for ejection is reduced.

Also, each cross-sectional shape of the large bore section 12 and the small bore section 13 of the nozzle 10 has a circular form and a lateral cross-section of each the large bore section 12 and the small bore section 13 has a shape of taper towards the ejection port 9 from the liquid supply port 11 in order to reduce resistance occurring between the liquid flowing through the inside the nozzle 10 and the each lateral side. In other words, each cross-sectional area of the large bore section 12 and the small bore section 13 reduces towards the ejection port 9 from the liquid supply port 11. Meanwhile, the large bore section 12 and the small bore section 13 do not have to be formed in the taper shape.

Also, the inside diameter of the ejection port 10 to which the small bore section communicates is less than 15 μm. Thereby, the strong electric field can be obtained at the front end section of the meniscus formed at the ejection port and the liquid droplet can be ejected consistently.

Figure 2:
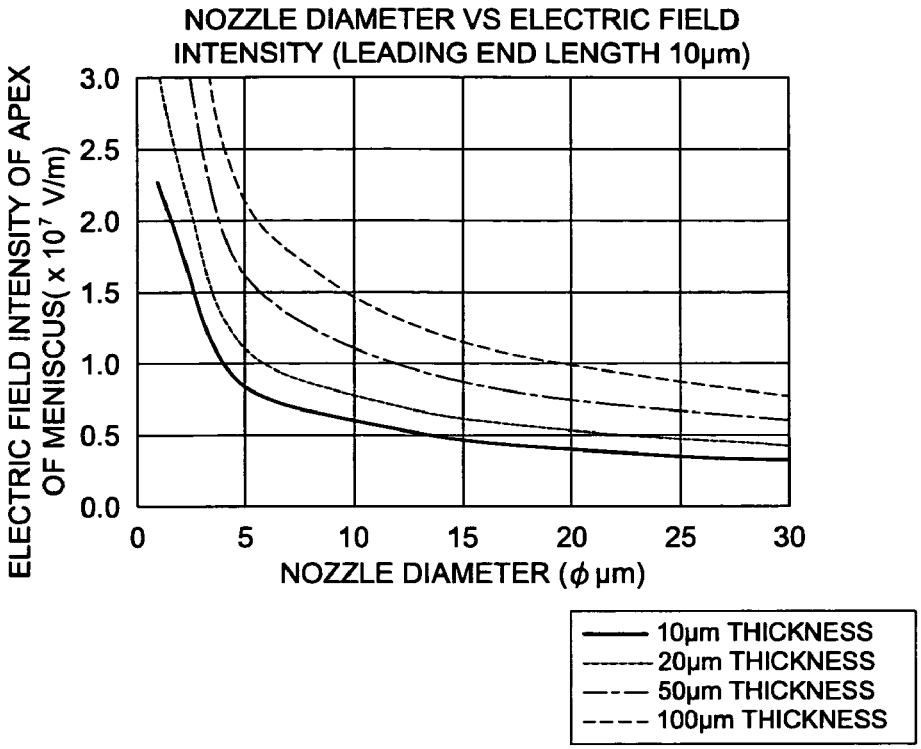
FIG. 2 is a graph indicating an exemplary relation between the nozzle diameter and the electric field intensity.
Figure 3:
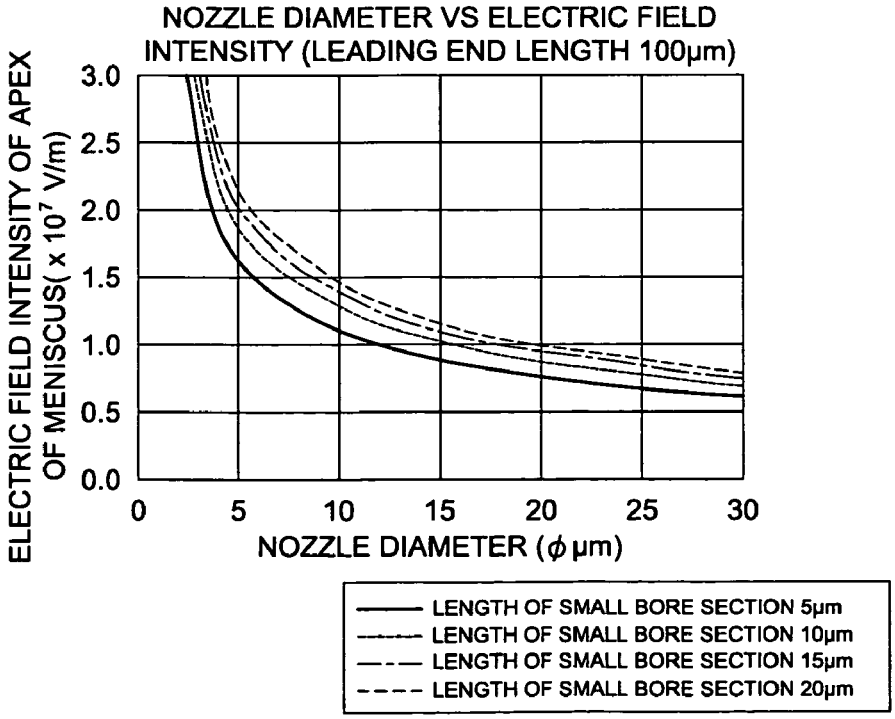
FIG. 3 is a graph indicating another exemplary relation between the nozzle diameter and the electric field intensity.

The electric field intensity at the meniscus front end section with respect to the inside diameter of common ejection port is indicated in FIG. 2 and FIG. 3. FIG. 2 indicates the electric field intensity at the meniscus front end section with respect to the inside diameter of the ejection port where a thickness H of the nozzle plate 5 is 10μ to 100 μm. Also, FIG. 3 indicates the electric field intensity at the meniscus front end section with respect to the inside diameter of the ejection port where a length L of the small bore section 13 is 5 μm to 20 μm. In both cases of FIGS. 2 and 3, the intensity of the electric field increases as the inside diameter of the ejection port decreases. As above, the higher intensity of the electric field can be obtained as the inside diameter decreases, and the liquid droplet can be ejected consistently, therefore the smaller inside diameter of the ejection port is preferred.

Also, each nozzle 10 is formed in a way that the nozzle does not protrude from the ejection surface 4 of the liquid ejection head 2.

The charging electrode 6 is configured with a conductive material such as NiP, mounted on an opposite surface to the ejection surface 4 on the nozzle plate 5, and extended to an inner periphery surface of the large bore section 12 of the nozzle 10. Thereby, with a structure where the charging electrode 6 contacts with the liquid flowing through inside the nozzle 10, the charging electrode 6 charges the liquid flowing through inside the nozzle 10.

Also, to the charging electrode 6, an electrostatic voltage power source 14 representing an electrostatic voltage application device to apply the electrostatic voltage for creating the electrostatic attraction force is connected electrically. Thereby since the a single charging electrode 6 is in contact with the liquid in all the nozzles, by applying the electrostatic voltage to the charging electrode 6 from the electro voltage power source 14, the liquid in all the nozzles 10 can be charged simultaneously. Therefore, the electrostatic attraction force is generated between the liquid ejection head 2 and the counter electrode 3 and in particular between the liquid and the substrate K.

In a body layer 7, the cavities 15 having the almost the same diameter as the liquid supply port 11 are provided respectively at a position corresponding to the liquid supply port 11 of the nozzle 10 so as to temporary reserve the liquid to be ejected.

A flexible layer 8 configured with a thin metal plate or a silicon having flexibility covers an opposite surface to the ejection surface 4 of the liquid ejection head 2 so as to demarcate the surface from outside. Meanwhile, an unillustrated flow pass to supply the liquid to the cavity 15 is formed at a boundary between the body layer 7 and the flexible layer 8.

Also, at a position corresponding to the cavity 15 on an upper surface of the flexible layer 8, a piezoelectric element 16 representing a piezoelectric element actuator is provided as a pressure generating device. Meanwhile, as the pressure generating device, beside the piezoelectric element actuator of the present embodiment, an electrostatic actuator and a thermal method can be utilized.

Also, to each piezoelectric element 16, a drive voltage power source 17 to apply the drive voltage to the element and to deform the element is connected respectively.

Also, to the electrostatic voltage power source 14 and the drive voltage power source 17, the control device 18 is electrically connected.

Next, the counter electrode 3 is a counter electrode in a shape of flat plate to support the substrate K, and disposed blow the liquid ejection head 2 in parallel with and being separated from the ejection surface 6 of the ejection head 2 with a predetermined dividing distance.

The counter electrode 3 is connected to the ground and is always maintained at a ground voltage level. Therefore, when the electrostatic voltage is applied to the charging electrode 6 from the electrostatic voltage power source 14, the electric field is created between the liquid in the ejection port 9 and an opposing surface of the counter electrode 3 facing the liquid ejection head 2.

Also, an unillustrated positioning device to move the liquid ejection head 2 and the substrate K relatively for positioning are equipped at the liquid ejection head 2 or the counter electrode 3.

Also, the unillustrated positioning device appropriately sets the deviation distance (gap) between the counter electrode 3 and the liquid ejection head 2 within a range of about 0.1 mm to 3.0 mm.

Next, a control configuration of the liquid ejection head 2 of the present embodiment will be described.

The electrostatic power source 14 applies the electrostatic voltage onto the charging electrode 6 in liquid ejection. Thereby, the liquid in all the nozzles 10 is charged simultaneously and the electrostatic attraction force is created between the liquid ejection head 2 and the counter electrode 3, in particular between the liquid and the substrate K.

In liquid ejection, the drive electric voltage power source 17 deforms the piezoelectric element 16 by applying the drive voltage to each piezoelectric element 16, generates a pressure in the liquid inside the nozzle 10 and forms the meniscus projecting in the ejection direction of the liquid at the ejection port 9. Thereby an extremely strong electric field concentration occurs at the meniscus front end section. Thus the meniscus is torn off by the electrostatic force of the electric field and separated from the liquid inside the nozzle 10 to be a liquid droplet. Further, the liquid droplet is accelerated by the electro static force and attracted to the substrate K supported by the counter electrode 3 then lands on the substrate K. When this occurs, since the liquid droplet tends to fly perpendicular to the substrate K with an effect of the electrostatic force, flying direction becomes steady and an accuracy of landing position is enhanced.

The control device 18 is configured with an unillustrated CPU 18*a*, a ROM 18*b* and a RAM 18*c*. The CPU 18*a* executes a program stored in the ROM 18*b* to drive the drive voltage power source 17 and the electrostatic voltage power source 14.

Specifically, to prevent occurrence of polarization on the nozzle plate, the control device 18 causes the electrostatic voltage power supply 14 to apply a bipolar pulse which alternates between positive polarity and negative polarity onto the charging electrode 6.

Figure 4:
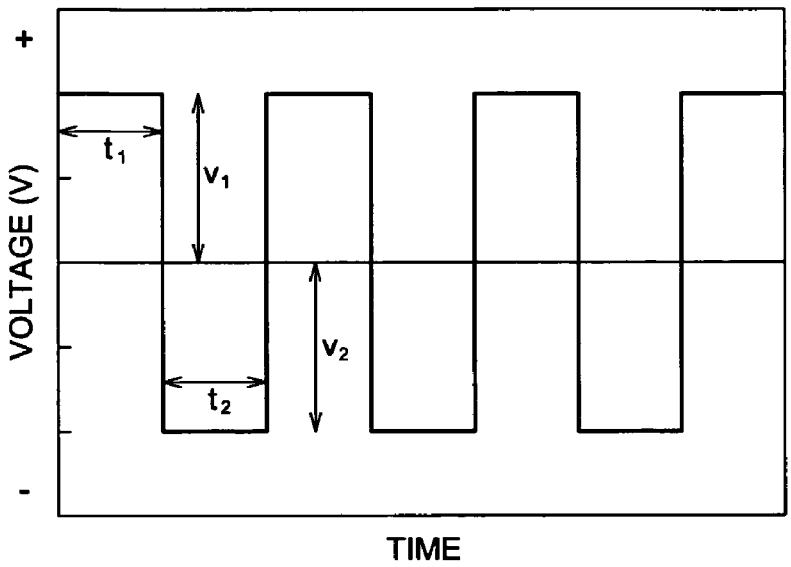
FIG. 4 is a graph indicating an exemplary electrostatic voltage applied to a liquid ejection head related to the present embodiment.

FIG. 4 shows the electrostatic voltage applied by the electrostatic voltage power source 14. In the present embodiment, as FIG. 4 shows, an electrostatic voltage value of a positive pulse is denoted by $v_1$, a pulse time thereof is denoted by $t_1$, an electrostatic voltage value of a negative pulse is denoted by $v_2$, a pulse time thereof is denoted by $t_2$ where the bipolar pulse is applied in a way that equations that pulse time t1=polarization recovery time t2 and |electrostatic voltage value v1|=|electrostatic voltage value v2| are satisfied.

Also, a minimum value of the pulse time t1 and pulse time t2 is a value not less than a time T1 which is from ejection of the liquid from the nozzle 10 to landing on the substrate K. Namely, pulse time $t_1$=pulse time $t_2 \geqq$predetermine time $T_1$. If the pulse time t1 or pulse time t2 is less than the predetermined time T1, there is a possibility that the polarity of the application voltage is reversed before the liquid droplet ejected from the nozzle 10 lands on the substrate K and the landing position of the liquid droplet deviates on the substrate K, however in the above method, the polarity of the electrostatic voltage is not allowed to be reversed thus deviation of the landing position of the droplet is prevented.

Given that a dividing distance (gap) between the liquid ejection head 2 and the counter electrode 3 is h (m) and an average velocity of the liquid droplet is v (m/s), the predetermined time T1 is described by the following equation (1).

[Equation 1]

$$T_1(s)=h/V(s) \quad (1)$$

For example, given that the gap h=1 mm, and the average velocity v=10 m/s, the predetermined time T1 from ejection of the droplet from the nozzle 10 to landing of the liquid droplet on the substrate K=100 μsec and the bipolar pulse is 5 kHz or less.

Meanwhile, as application wave of the electrostatic voltage, a sine wave, a triangle wave or a saw-tooth wave can be used without being limited to the rectangular pulse wave shown in FIG. 4.

Figure 5:
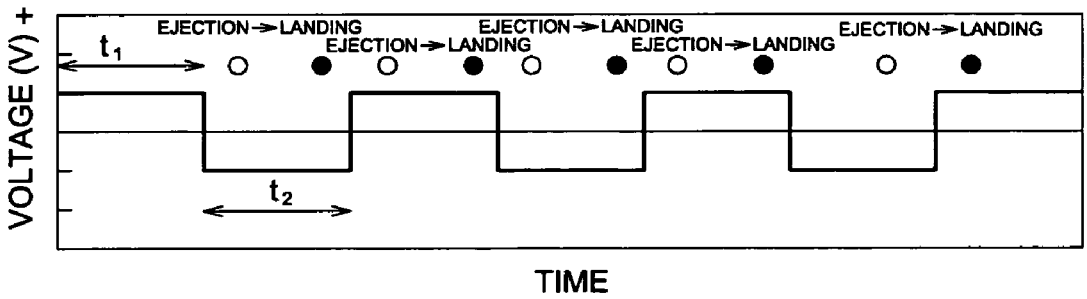
FIG. 5 is a chart indicating a relation between a drive frequency of a piezoelectric element and a bipolar pulse voltage related to the present embodiment.

FIG. 5 is a chart diagram of bipolar pulse where an ejection timing of the liquid droplet and reversal timing of the bipolar pulse is synchronized as well as the values of the pulse time $t_1$ and $t_2$ are not less than the predetermined time $T_1$. As shown by FIG. 5 at right end, in case the ejection timing and the reversal timing of the bipolar pulse do not synchronize, the bipolar pulse is reverse while the liquid droplet is flying thus it will cause the deviation of landing position.

On the other hand, maximum values of the pulse time $t_1$ and the pulse time $t_2$ stay at least not more than the predetermined time $T_2$ which is from application of the electrostatic voltage until decreasing of the electric filed intensity at meniscus front end section starts due to continuous application of the electrostatic voltage onto the charging electrode 6 for a predetermined time 1. Thereby polarity of the electrostatic voltage is reversed before the nozzle plate is polarized and the polarization of the nozzle plate 5 can be prevented.

Figure 6:
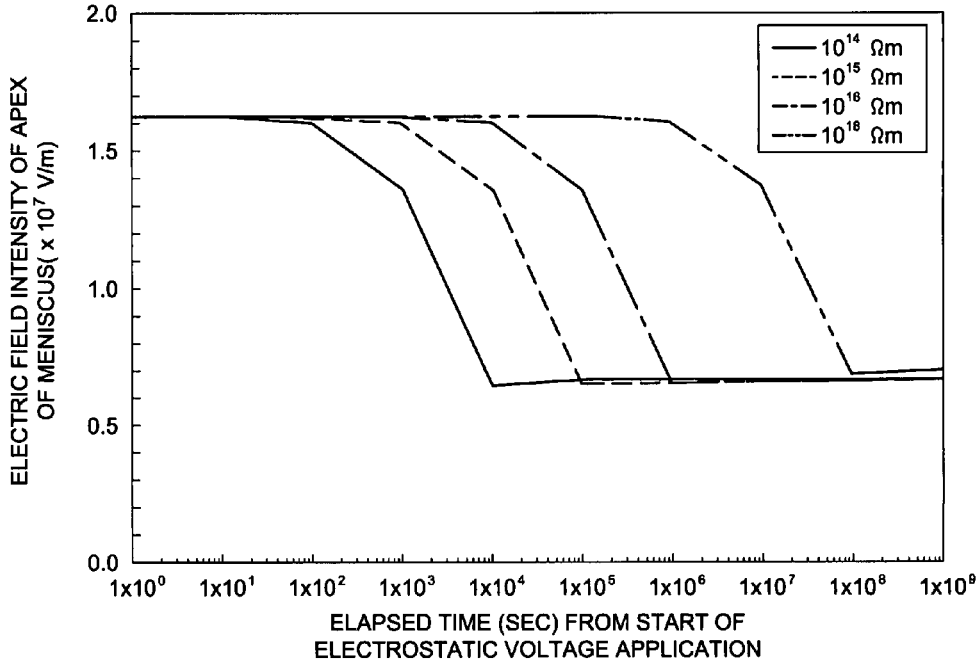
FIG. 6 is a graph indicating change of an electric field intensity at a front end section of the meniscus in respect to the pulse time.

FIG. 6 shows change of the electric field intensity at meniscus front end section with respect to the pulse time. As FIG. 6 shows, by continuous application of electrostatic voltage for a predetermined time onto the charging electrode 6, the nozzle plate 5 polarizes in the predetermined time $T_2$ and the electric field intensity at the meniscus front end section starts to deteriorate. Meanwhile, the predetermined time $T_2$, till the electric field intensity starts to deteriorate varies with the volume resistivity of the nozzle plate 5, and the higher volume resistivity maintains a state of high electric field intensity the longer period of time. For example, more than $10^{15}$ Ωm is utilized preferably from a view point that option of the pulse width is broad.

As above, by continuous liquid ejection operation where the electrostatic voltage having the same polarity is applied between the nozzle plate 5 and the counter electrode 3, the electric field intensity is deteriorated due to the polarization of the nozzle plate 5 and the liquid ejection state changes, however by alternating polarity of the bipolar pulse between positive and negative in liquid ejecting, polarization of the nozzle plate 5 is prevented.

Meanwhile, the application wave shape of the electrostatic voltage of the present invention is not necessary that $t_1=t_2$, $v_1=v_2$, and an electrostatic voltage application method that t1≠t2, v1≠v2 can be utilized as far as the application wave is the bipolar pulse. In this case though space-charge polarization (ionic polarization) of the nozzle plate gradually progresses along with application of the electrostatic voltage, the progress of the polarization is suppressed compared with the case that the electrostatic voltage having the same polarity is applied continuously, and an effect that an ejection time in which consistent liquid ejection is possible is extended.

Next, a liquid ejection method of the present invention using the liquid ejection head 2 will be described.

When the liquid ejection apparatus 1 starts liquid ejection operation, the electrostatic voltage power source 14 applies the bipolar pulse which alters between negative and positive polarity onto the charging electrode 6 by control of the control device 18.

Namely, As FIG. 4 shows, the electrostatic voltage power source 14 repeats operation where the positive pulse having the electrostatic voltage $v_1$ is applied for the pulse time $t_1$ then the polarity of the application voltage is reverse and the electrostatic voltage $v_2$ having negative pulse $t_2$ is applied for the pulse time 2. By applying the positive pulse and the negative pulse, the liquid in the nozzle 10 is charged and an electrostatic attraction force is generated between the liquid and the substrate K.

In the liquid ejection method of the present invention, the bipolar pulse, which alternates between positive and negative polarity, is applied in a way that pulse time $t_1$=polarization recovery time $t_2$ and |electrostatic voltage $v_1$|=|electrostatic voltage $v_2$|.

Also, pulse time $t_1$=pulse time $t_2 \geqq$pulse time $T_1$. Thereby, as FIG. 5 shows, the polarity of the application voltage does not change before the liquid droplet lands on the substrate K, thus deviation of the landing position on the substrate K can be prevented.

Also, maximum values of the pulse time $t_1$ and the pulse time $t_2$ are at least not more than the predetermined time $T_2$ which is until the nozzle plate 5 is polarized by applying the electrostatic voltage for the predetermined time onto the charging electrode 6 and the electric filed intensity at the meniscus front end section starts to deteriorate. Thereby polarity of the electrostatic voltage is reversed before the nozzle plate is polarized and the polarization of the nozzle plate 5 can be prevented.

On the other hand, the drive voltage power source 17 deforms the piezoelectric element 16 by applying a drive voltage onto each piezoelectric element 16, and generates a pressure in the liquid in the nozzle 10 so as to form a meniscus projecting in ejection direction of the liquid at the ejection port 9. Then, a strong concentration of the electric field is generated at the meniscus front end section and the meniscus is torn off from the liquid in the nozzle 10 to be a liquid droplet. Further the liquid droplet is accelerated by electrostatic force and attracted by the substrate K supported by the counter electrode 3 and lands on the substrate K thereof.

As above, according to the liquid ejection method and liquid ejection head 2 each related to the present embodiment, though the electric field intensity is deteriorated and liquid ejection becomes impossible due to polarization of nozzle plate 5 when liquid ejection operation is continued for a long time of period by applying the electrostatic voltage having the same polarity between the insulating flat nozzle plate 5 and the counter electrode 3, the polarization of the nozzle plate 5 can be suppressed by applying positive pulse and negative pulse alternately to carry out liquid ejection operation. Thereby in case the liquid ejection head 2 is used in a production line, ejection operation can be continued without deteriorating productivity due to defective liquid ejection.

Also, the polarization of the nozzle plate can be prevented by applying the negative pulse having the same integrated value of the electrostatic voltage value with respect to the pulse time as that of the positive pulse after applying the positive pulse.

Also, if the pulse time of each of positive pulse and negative pulse is less than the predetermined time by landing of the liquid droplet onto the substrate K, the polarity of the application voltage is reversed before the liquid droplet lands on the substrate K. However, by preventing the application voltage form reversal of polarity while the liquid droplet is flying, the deviation of landing position of the liquid droplet can be prevented.

Also, by synchronizing drive of the piezoelectric element 16 with the bipolar pulse, the ejection timing does not deviate in respect to the electrostatic wave thus reversal of the polarity of the application voltage is prevented while the liquid droplet is flying.

Also, by making the inside diameter of the ejection port less than 15 μm, the electric field at the meniscus front end section concentrates effectively, thus the liquid droplet can be ejected steady and efficiently.

The present invention will be specifically described with reference to the embodiment without the embodiment of the present invention being restricted thereto.

Comparison Example 1

Figure 7:
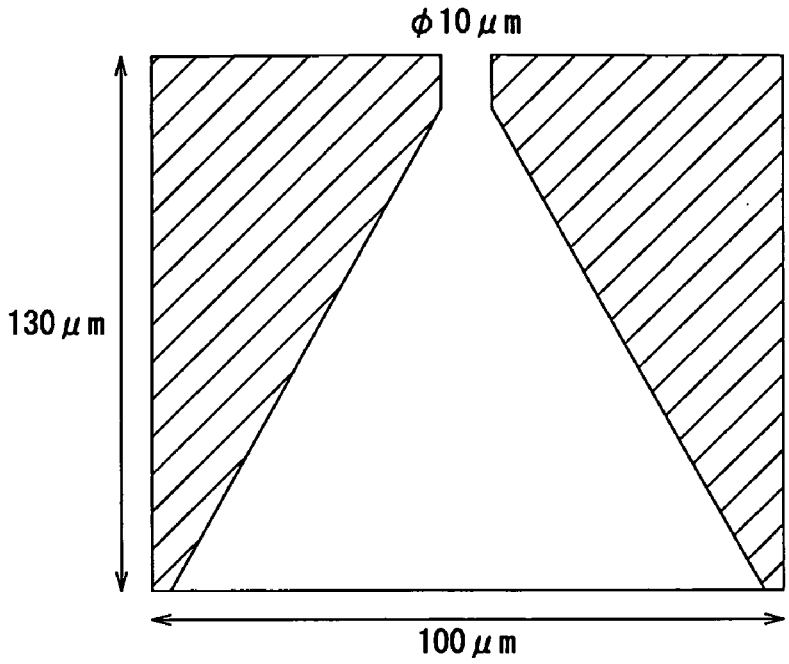
FIG. 7 is a cross-sectional view showing a shape of a nozzle related to the present embodiment.
Figure 8:
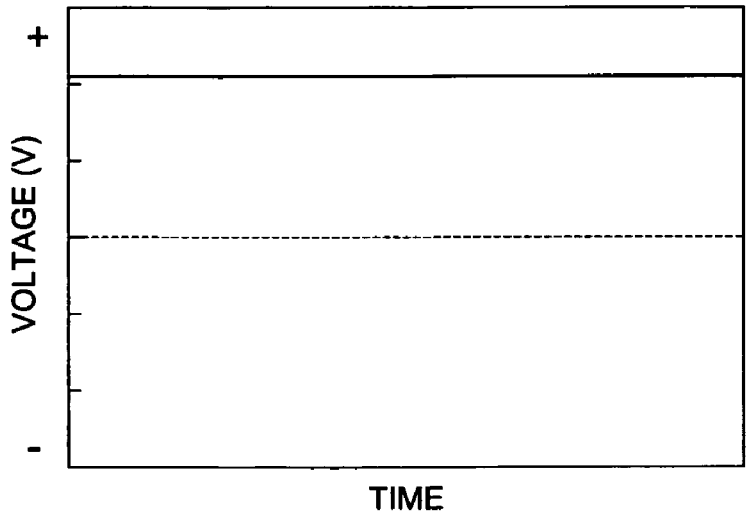
FIG. 8 is a graph indicating a wave shape of application voltage related to the present embodiment.

As FIG. 7 shows, a nozzle having a large bore section in a taper shape, a nozzle height of 130 μm, liquid supply port inside diameter of 100 μm and an ejection port inside diameter of 10 μm are formed on a nozzle plate configured with PET (Toray Industries Inc. lumilor X10S™) having a volume resistivity of $10^{16}$ Ωm and a relative permittivity of 2.5. Also, as FIG. 8 shows, the electrostatic voltage having an application voltage of 2.0 kV/mm in the same polarity is applied to eject the liquid.

Exemplary Embodiment 1

Figure 9:
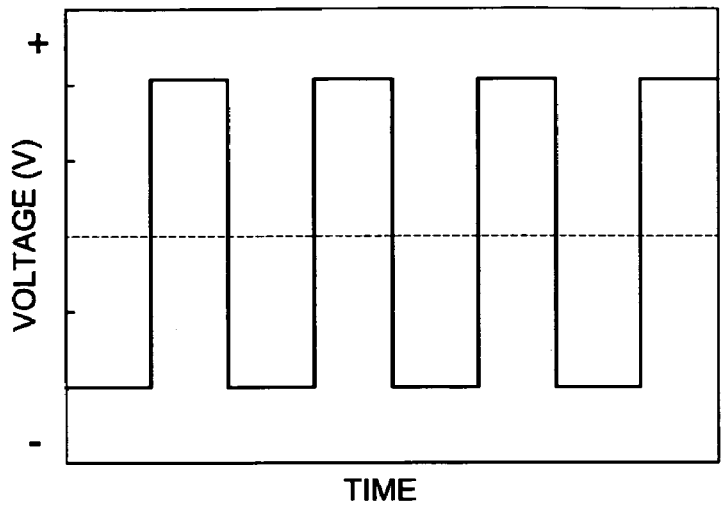
FIG. 9 is a graph indicating a wave shape of application voltage related to the present embodiment.

The electrostatic voltage in the same polarity of the comparison example 1 is a bipolar pulse wave 1 shown in FIG. 9.

Comparison Example 2

Figure 10:
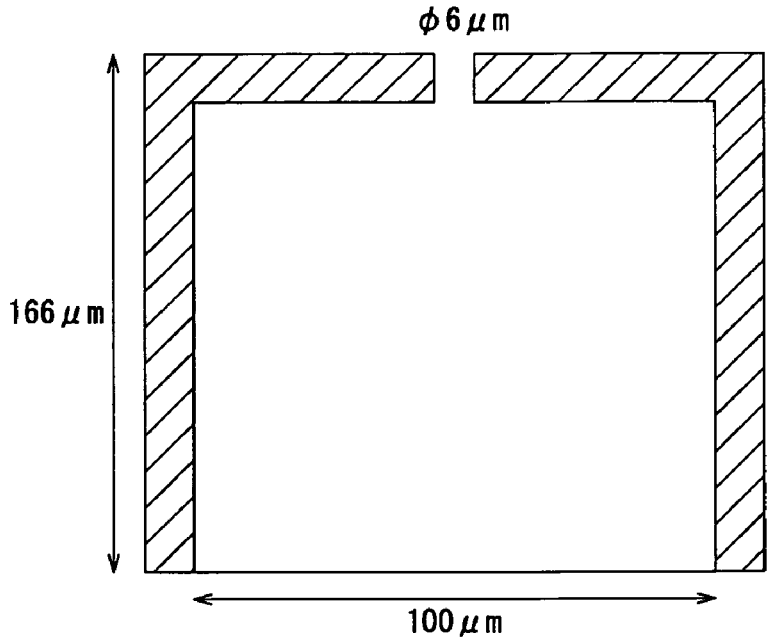
FIG. 10 is a cross-sectional view showing a shape of a nozzle related to the present embodiment.

As FIG. 10 shows, a nozzle having a nozzle height of 166 μm, a liquid supply port inside diameter of 100 μm and an ejection port inside diameter of 6 μm are formed on a nozzle plate configured with a silica glass (Asahi Glass Co., Ltd. Synthetic Silica Glass AQ™) having a volume resistivity of $3\times10^{16}$ Ωm and a relative permittivity of 3.5. Also, as FIG. 8 shows, the electrostatic voltage having an application voltage of 2.5 kV/mm in the same polarity is applied to eject the liquid.

Exemplary Embodiment 2

Figure 11:
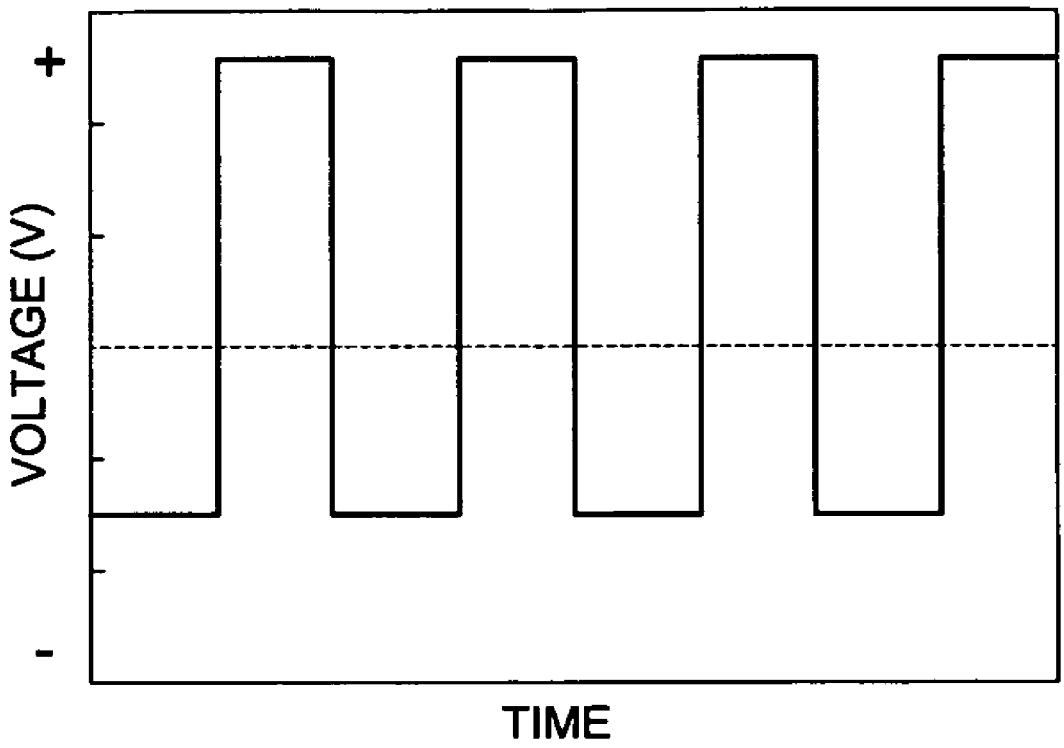
FIG. 11 is a graph indicating a wave shape of application voltage related to the present embodiment.

The electrostatic voltage in the same polarity of the comparison example 2 is the bipolar pulse wave 2 shown in FIG. 11.

Exemplary Embodiment 3

The electrostatic voltage in the same polarity of the comparison example 2 is the bipolar pulse wave 1 shown in FIG. 9.

In respect to each condition thereof, ejection time in which the liquid is ejected from nozzle consistently was evaluated. The table 1 shows results of evaluation.

TABLE 1

| | Nozzle material | Volume resistivity [Ωm] | Relative permittivity | Application voltage wave shape | Application voltage [kV/mm] | time |
|---|---|---|---|---|---|---|
| Comparison example 1 | PET | $10^{16}$ | 2.5 | Static Electric Field | 2.0 | 3 hours |
| Comparison example 1 | PET | $10^{16}$ | 2.5 | Pulse Wave 1 | 2.0 | More than 24 hours |
| Comparison example 2 | Silica Glass | $3 \times 10^{16}$ | 3.5 | Static Electric Field | 2.5 | 4.5 hours |
| Comparison example 2 | Silica Glass | $3 \times 10^{16}$ | 3.5 | Pulse Wave 2 | 2.5 | 20 hours |
| Comparison example 3 | Silica Glass | $3 \times 10^{16}$ | 3.5 | Pulse Wave 1 | 2.5 | More than 24 hours |

As the table 1 reveals, in case the electrostatic voltage in the same polarity was continuously applied as the comparison examples 1 and 2, steady ejection time of the liquid remains 3 to 4.5 hours. Contrarily, in case the bipolar pulse wave of the present invention is applied as the exemplary embodiments 1 to 3, the steady ejection time of the liquid is prolonged. In the exemplary embodiments 1 to 3 in particular, in case the wave shape, where the integrated values of the voltage values with respect to time in a positive side and a negative side equate, is utilized, ejection of the liquid is steady even at time point where 24 hours has elapsed, and a high efficiency was obtained.

As described in the foregoing, according to the liquid ejection head and the liquid ejection method of the present invention, polarization of the nozzle plate can be suppressed by applying the negative pulse before the nozzle plate is polarized by applying the positive pulse. Thereby, the ejection operation can be continued without deteriorating productivity due to defective liquid ejection in case the liquid head is utilized in a production line. Meanwhile, the embodiments where the electrostatic voltage is applied to the liquid in the liquid ejection head and the counter electrode is grounded have been described. Contrarily, an embodiment where the electrostatic voltage is applied on the counter electrode and liquid ejection head is grounded can be utilized to obtain the same effect.

What is claimed is:

1. A liquid ejection apparatus comprising:

a liquid ejection head to eject liquid having:

an insulating nozzle plate provided with a nozzle having, a liquid supply port to supply liquid and an ejection port to eject the liquid supplied from the liquid supply port onto a substrate; and a cavity in communication with the liquid supply port to reserve the liquid to be ejected from the ejection port;

an electrostatic voltage application device to generate an electrostatic attraction force by applying the electrostatic voltage between the liquid in the nozzle and in the cavity, and substrate; and a control device to control application of the electrostatic voltage through the electrostatic voltage application device;

wherein the nozzle is a flat nozzle not protruding from the nozzle plate and the control device controls the electrostatic voltage application device so as to eject the liquid from the nozzle by applying a bipolar pulse which alternates between negative and positive polarities wherein and the bipolar pulse is a bipolar pulse in which an integrated value of the electrostatic voltage value of the positive pulse with respect to pulse time is equated to an integrated value of the electrostatic voltage value of the negative pulse with respect to pulse time.

2. The liquid ejection apparatus of claim 1, wherein the liquid ejection head further comprises a pressure generating device to generate a pressure in the liquid by changing a volume of the cavity for forming a meniscus at the ejection port, wherein the control device drives the pressure generating device so as to synchronize with the bipolar pulse.

3. The liquid ejection apparatus of claim 1, wherein a volume resistivity of the nozzle plate is not less than $10^{15}$ Ωm.

4. The liquid ejection apparatus of claim 1, wherein an inside diameter of the ejection port is less than 15 μm.

5. A liquid ejection apparatus comprising:

a liquid ejection head to eject liquid having:

an insulating nozzle plate provided with a nozzle having, a liquid supply port to supply liquid and an ejection port to eject the liquid supplied from the liquid supply port onto a substrate;

a cavity in communication with the liquid supply port to reserve the liquid to be elected from the election port;

an electrostatic voltage application device to generate an electrostatic attraction force by applying the electrostatic voltage between the liquid in the nozzle and in the cavity, and substrate; and a control device to control application of the electrostatic voltage through the electrostatic voltage application device;

wherein the nozzle is a flat nozzle not protruding from the nozzle plate and the control device controls the electrostatic voltage application device so as to elect the liquid from the nozzle by applying a bipolar pulse which alternates between negative and positive polarities, and a pulse time of at least one of positive pulse or negative pulse of the bipolar pulse is not less than a predetermined time from ejection of the liquid through the nozzle to landing of the liquid thereof onto the substrate.

6. A liquid ejection method, comprising:

using a liquid ejection head having;

an insulating nozzle plate provided with a nozzle having, a liquid supply port to supply liquid and an ejection port to eject the liquid supplied from the liquid supply port onto a substrate, and a cavity in communication with the liquid supply port to reserve the liquid to be elected from the ejection port, an electrostatic voltage application device to generate an electrostatic attraction force by applying the electrostatic voltage between the liquid in the nozzle and in the cavity, and substrate, and a control device to control application of the electrostatic voltage through the electrostatic voltage application device;

wherein the nozzle is a flat nozzle not protruding from the nozzle plate and the control device controls the electrostatic voltage application device so as to eject the liquid from the nozzle by applying a bipolar pulse which alternates between negative and positive polarities and the bipolar pulse is a bipolar pulse in which an integrated value of the electrostatic voltage value of the positive pulse with respect to pulse time is equated to an integrated value of the electrostatic voltage value of the negative pulse with respect to pulse time.

7. The liquid ejection method of claim 6, wherein the pulse time of at least one of positive pulse or negative pulse of the bipolar pulse is not less than a predetermined time from ejection of the liquid through the nozzle to landing of the liquid thereof onto the substrate.

8. The liquid ejection method of claim 7, further comprising a pressure generating device to generate a pressure in the liquid by changing a volume of the cavity for forming a meniscus at the ejection port, wherein the control device drives the pressure generating device so as to synchronize with the bipolar pulse.

9. The liquid ejection method of claim 7, wherein a volume resistivity of the nozzle plate is not less than $10^{15}$ Ωm.

10. The liquid ejection method of claim 7, wherein an inside diameter of the ejection port is less than 15 μm.

* * * * *